United States Patent [19]

Sansky

[11] Patent Number: 4,611,197

[45] Date of Patent: Sep. 9, 1986

[54] MALFUNCTION-DETECTING STATUS MONITORING SYSTEM

[76] Inventor: Michael J. Sansky, 504 Via Juarez, San Clemente, Calif. 92672

[21] Appl. No.: 703,092

[22] Filed: Feb. 19, 1985

[51] Int. Cl.[4] ..... G08B 19/00

[52] U.S. Cl. ..... 340/522; 340/521; 340/523; 340/508; 340/506; 340/525; 340/526; 340/527; 340/309.15

[58] Field of Search ..... 340/522, 521, 506, 508, 340/507, 523, 524, 525, 527, 528, 526, 309.15

[56] References Cited

U.S. PATENT DOCUMENTS

| | | | |
|---|---|---|---|
| 3,599,195 | 8/1971 | Boyko | 340/522 |
| 3,675,204 | 7/1972 | Miehle | 340/286 |
| 3,801,978 | 4/1974 | Gershberg | 340/522 |
| 3,979,740 | 9/1976 | Forbat | 340/309.15 |
| 4,012,730 | 3/1977 | Nicholls . | |
| 4,086,574 | 4/1978 | Miyabe . | |
| 4,195,296 | 3/1980 | Galvin | 340/522 |
| 4,296,451 | 10/1981 | Wilkinson . | |
| 4,356,476 | 10/1982 | Healey et al. | 340/522 |
| 4,401,976 | 8/1983 | Stadelmayr | 340/522 |
| 4,536,747 | 8/1985 | Jensen | 340/522 |

*Primary Examiner*—Donnie L. Crosland

*Attorney, Agent, or Firm*—Fulwider, Patton, Rieber, Lee & Utecht

[57] ABSTRACT

A multiple-sensor status monitoring system for monitoring the status of an area while avoiding false alarms and detecting and identifying faulty sensors. The system uses a timer and logic to avoid false alarms by generating an alarm signal only if two sensors give a response within a preselected interval of time. The system employs latching storage elements to keep a record of which of the sensors have made spurious responses, and a visual display to give a trouble warning respecting those sensors.

23 Claims, 6 Drawing Figures

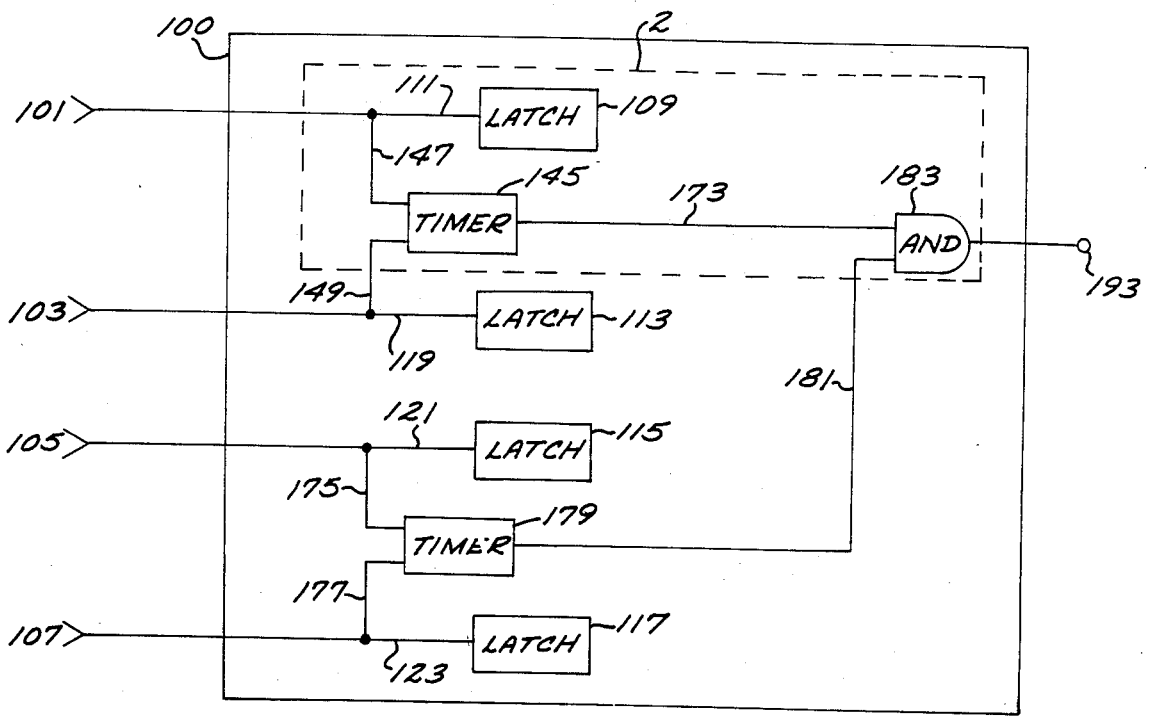
FIG. 1
FIG. 2
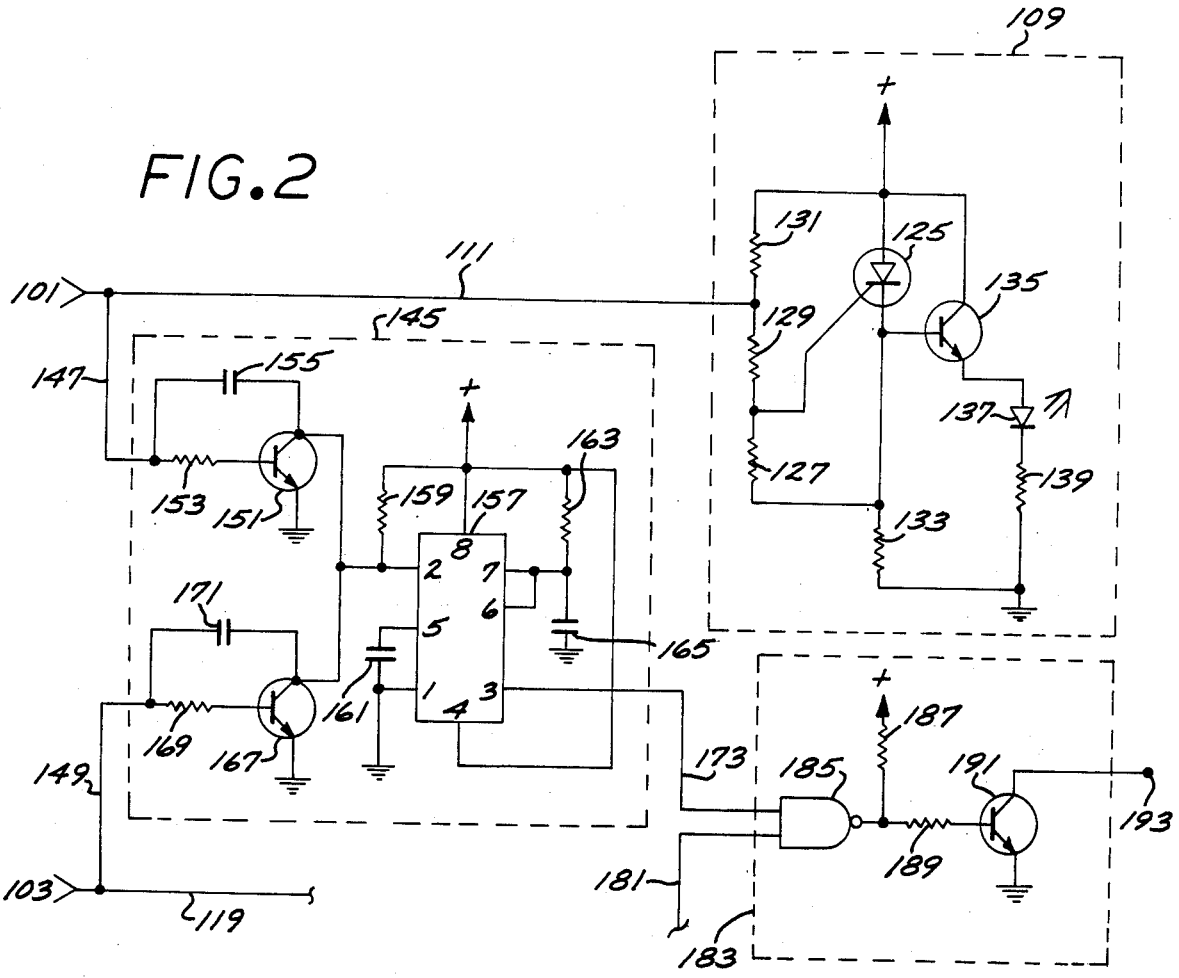

MALFUNCTION-DETECTING STATUS MONITORING SYSTEM

BACKGROUND OF THE INVENTION

1. Field of the Invention

The present invention relates to status monitoring systems such as burglar or fire alarm systems, and more particularly to status monitoring systems employing multiple sensors and special logic to reduce the probability of false alarms.

2. The Prior Art

Status monitoring systems using multiple sensors and logic circuitry to discriminate against false alarms are known to the art. Such logic circuitry generally accomplishes its function of avoiding false alarms by generating an alarm signal only if two or more of the sensors generate response signals within a predetermined interval of time. An example of such a system is found in U.S. Pat. No. 4,195,296, dated Mar. 25, 1980, issued to Galvin.

A problem with existing multiple-sensor status monitoring systems is the failure of such systems to give a trouble signal if a sensor malfunctions. A sensor malfunction may take the form either of a failure to respond to a stimulus or of a spurious response in the absence of a stimulus. The first kind of malfunction—failure to respond at all—can result in a failure to sound the alarm when the status being monitored changes. The second kind of malfunction—a spurious response—can result in a false alarm. Neither kind of sensor malfunction produces a trouble warning in existing multiple-sensor status monitoring systems, and hence there is no way to know that one or more sensors have malfunctioned until one or the other kind of system failure occurs.

Moreover, even if there is a system failure, if a sensor is malfunctioning intermittently there is no way to determine which of the various sensors is the cause of the trouble, and hence troubleshooting such a system failure is virtually impossible.

A partial solution to the problem of generating a trouble warning in the event of the first kind of sensor malfunction—failure to respond at all—is disclosed in U.S. Pat. No. 3,801,978, issued Apr. 2, 1974 to Gershberg. The Gershberg patent discloses an intrusion alarm system comprising the combination of a microwave motion sensor and an ultrasonic motion sensor. False alarms are avoided by activating an alarm only if both sensors simultaneously signal the presence of an intruder. The alarm is also activated if either sensor fails to function, but only a complete failure of either the microwave or the ultrasonic sensing signal causes alarm activation. So long as both sensors are radiating sensing signals, the failure of either sensor to respond to a proper stimulus will not be detected. A further limitation of the Gershberg system is that even in the event of a complete failure of one of the sensing signals, the Gershberg system does not identify the sensor that has failed.

Even the limited failure-detecting ability of the apparatus disclosed by Gershberg only works with an energy radiating sensor such as a microwave or ultrasonic motion detector. A passive sensor is not adaptable to being monitored by the Gershberg apparatus, and hence a failure of a passive sensor will not be detected by such apparatus.

A spurious response in the absence of a proper stimulus is easy to detect in a single-sensor status monitoring system because such a response activates the system's alarm. Since there is only one sensor, locating the fault is relatively simple once it has been determined that the alarm was a false alarm. However, a multiple-sensor system—even the Gershberg system—does not activate its alarm if it detects a response signal from only one sensor. A spurious response signal from any one sensor, regardless of whether the signal is continuous or intermittent, is simply ignored. Hence, since there is neither an alarm nor a trouble warning, the defective sensor will continue to malfunction and system performance will be degraded.

A partial solution to the problem of detecting a spurious response from one sensor is proposed in the multiple-sensor system disclosed in the Galvin patent. The Galvin system has logic circuitry to generate a first alarm signal if any one sensor is activated and to generate a second alarm signal only if at least two sensors are activated within a predetermined interval of time. Thus, if the first alarm, but not the second alarm, sounds, once it has been determined that the alarm was false, it will be apparent that one of the sensors has given a spurious response. However, in Galvin's apparatus there is no way to determine which sensor has caused the trouble.

It will be apparent from the foregoing that there is a need for a multiple-sensor status monitoring system having the ability to warn of a sensor malfunction either of the first kind or of the second kind and to identify the malfunctioning sensor. The present invention satisfies this need.

SUMMARY OF THE INVENTION

The present invention resides in a multiple-sensor status monitoring system. The system has a plurality of sensors that each provide a primary signal in response to a stimulus. A storage means coupled to each sensor keeps an electronic record of the occurrence of a primary signal from that sensor. In addition, each sensor is connected to one of a plurality of timers, and each timer provides a timing output signal of fixed duration in response to a primary signal from any of the sensors connected to that timer. A logic means connected to the timers generates a status change signal if a timing output signal from one timer overlaps such a signal from any other timer. Thus, an alarm is sounded only if at least two sensors provide primary signals within a predetermined time of each other.

A sensor malfunction manifested by the generation of spurious responses from a sensor can be detected by examining the record kept by the storage means of primary signals provided by each sensor. A sensor malfunction manifested by a failure to respond to a valid stimulus can be detected by deliberately introducing a stimulus throughout the area being monitored and then determining from the record which sensors failed to provide primary signals in response to the stimulus.

In one embodiment, the storage means takes the form of a plurality of silicon-controlled rectifiers ("SCRs"), one for each sensor, wired into simple latch circuits. A primary signal from a given sensor latches the SCR associated with that sensor; once latched, the SCR stays latched until it is manually reset. Indicator means associated with each latch may take the form of a light-emitting diode ("LED") to indicate latching.

The timers and logic circuit prevent a status change alarm signal from being generated unless at least two different sensors provide primary signals within a predetermined period of time. Some of the sensors are connected to one timer and some to each of the other timers. If a sensor provides a primary signal, then the timer to which that sensor is connected generates a timer output signal having a duration of about three minutes. If a sensor connected to another timer also provides a primary signal, then that other timer also generates a timer output signal. The logic circuit generates a status change alarm signal only if output signals from both timers overlap in time. During initial system design, the sensors are laid out such that a bona fide change in status will of necessity cause primary signals to be provided by at least two different sensors, not all of which are connected to the same timer. In this way, the probability of false alarms is greatly reduced because a spurious signal from any one sensor will not sound the alarm, but signals from two sensors within three minutes of each other will sound the alarm.

In another embodiment, a circuit is provided that can "freeze" all the latches and timers, rendering them insensitive to primary sensor signals. This feature is desirable if the invention is embodied in a burglar alarm having a control panel located within the protected area. Typically, a burglar alarm is only activated during hours when the premises being guarded are deserted. When the premises are opened, it is necessary for a person to enter the protected area and proceed to the control panel to shut off the alarm. By making such an entry and walking through the protected area to the control panel, the person will of necessity activate one or more of the sensors, but it is not desirable for a record of such activations to be stored by the latches. Accordingly, the freeze circuit can be activated so that the person can enter the premises and shut off the alarm without either sounding the alarm or causing a record of sensor activations to be stored in the latch circuits.

In still another embodiment, an exit delay circuit is provided. This circuit "freezes" the timers and latches for a predetermined interval of time after the alarm system has been turned on, so that the person who turns the system on has time to leave the protected area without setting off the alarm.

It will be appreciated from the foregoing that the present invention represents a significant advance in the field of multiple-sensor status monitoring systems. In particular, a status monitoring system incorporating this invention gives a trouble warning in the event any of its sensors gives a spurious response and identifies which sensor or sensors have given such responses. The system is also capable of detecting and identifying non responsive sensors during system testing.

Other aspects and advantages of the present invention will become apparent from the following more detailed description taken in conjunction with the accompanying drawings.

BRIEF DESCRIPTION OF THE DRAWINGS

FIG. 1 is a block diagram of a multiple-sensor status monitoring system according to the invention;

FIG. 2 is a schematic diagram of the circuitry contained within box 2 of FIG. 1;

DESCRIPTION OF THE PREFERRED EMBODIMENT

Figure 3:
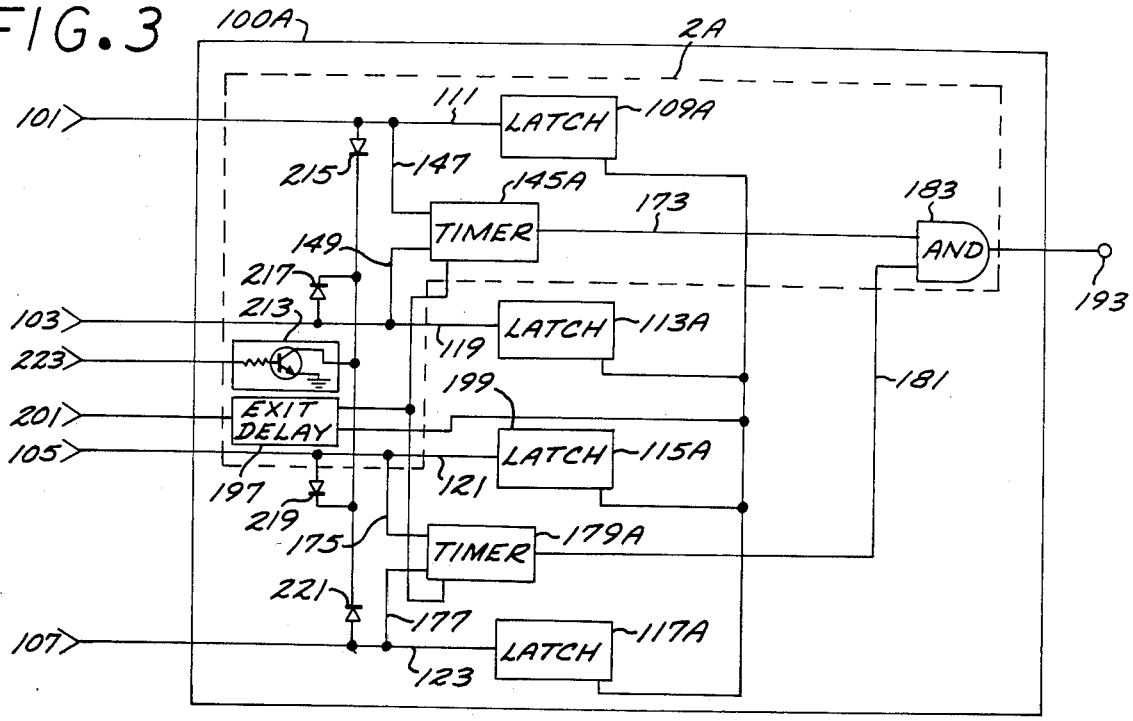
FIG. 3 is a block diagram of a multiple-sensor status monitoring system that is similar to the system shown in FIG. 1 except for the addition of an exit delay circuit and a circuit to prevent sensor activations if a first alarm signal has been generated.

Multiple-sensor status monitoring systems with logic for avoiding false alarms give no warning of the failure of any one sensor. The present invention provides a multiple-sensor status monitoring system that stores and displays a record of the primary signals provided by each sensor but sounds no alarm unless two or more different sensors generate primary signals within a predetermined interval of time.

A multiple-sensor status monitoring system 100 embodying the present invention has sensor inputs 101, 103, 105 and 107, as shown in FIG. 1. Each input is configured for connection to a sensor, such as a normally-closed switch, that presents a closed circuit to ground when said sensor is not activated and an open circuit when said sensor is activated, the primary signal provided by such a sensor being the interruption of the connection between ground and the input to which said sensor is connected. It will be apparent to those skilled in the art, however, that said inputs could be configured to accept other kinds of primary signals if desired.

Sensor input 101 is connected to a latch circuit 109 through a conductor 111. In similar fashion, sensor inputs 103, 105 and 107 are connected to identical latch circuits 113, 115 and 117 through conductors 119, 121 and 123, respectively.

Typical latch circuit 109, shown schematically in FIG. 2, has a silicon-controlled rectifier ("SCR") 125 that is held quiescent by bias resistors 127, 129 and 131 until a sensor connected to input 101 provides a primary signal to the gate of SCR 125, and then SCR 125 begins to conduct, causing a voltage to develop across resistor 133 in the cathode circuit of SCR 125. Said voltage is applied to the base of transistor 135, and emitter current begins to flow. Said emitter current flows through current limiting resistor 139 and light-emitting diode ("LED") 137, and LED 137 begins to emit light. Once SCR 125 begins to conduct, it continues to conduct regardless of the status of the sensor connected to input 101, and hence LED 137 remains lit, thereby giving a continuous indication that a primary signal was received from said sensor.

In like manner, latch circuits 113, 115 and 117 are triggered by primary sensor signals occurring at inputs 103, 105 and 107, respectively, and LEDs associated with said latch circuits are illuminated in similar fashion.

Input 101 is connected to timer 145 through conductor 147, and input 103 is connected to timer 145 through conductor 149. A primary signal at input 101 is applied to a one-shot multivibrator comprising transistor 151, resistor 153, and capacitor 155, causing the multivibrator to produce a short output pulse that is applied to pin 2 of a pulse generator comprising a type 555 integrated circuit 157, resistor 159, capacitor 161, and time constant determinants resistor 163 and capacitor 165. In like manner, a primary signal at input 103 is applied to an identical one-shot multivibrator comprising transistor 167, resistor 169 and capacitor 171, causing a short output pulse to be applied to pin 2 of integrated circuit 157.

Upon receiving a short input pulse from either of said multivibrators, integrated circuit 157 provides at conductor 173 a timer output signal having a duration governed by resistor 163 and capacitor 165. In similar fashion, inputs 105 and 107 are connected through conductors 175 and 177, respectively, to identical timer 179, and a primary signal from either input 105 or 107 results in a timer output signal at conductor 181.

Although the duration of the timer output signals is not critical, for a typical burglar alarm installation a duration of about three minutes gives good results.

Timer output signals from timers 145 and 179 are applied to logic block 183. Logic block 183 includes NAND gate 185, resistors 187 and 189, and output transistor 191. When the circuit is at rest, the output of gate 185 is high, causing transistor 191 to appear as a closed circuit to ground at output 193. A timer output signal from only one of timers 145 and 179 will not change this status, but if at any moment timer output signals from both said timers are simultaneously present at the inputs to gate 185, then transistor 191 will appear as an open circuit at output 193, and this appearance as an open circuit constitutes a status change output signal.

The probability of a false alarm is reduced by causing transistor 191 to switch to an open circuit from a closed circuit to ground only if two different sensors provide primary signals within a predetermined time set by time constant components 163 and 165 and by the comparable components in timer 179. If a sensor malfunctions so as to provide a continuous primary signal, the multivibrator that couples that sensor to its associated timer blocks such a continuous signal from interfering with normal operation of the timer and the other sensors connected thereto.

An embodiment of the invention having certain additional features that are especially desirable in burglar alarm systems is shown in block form in FIG. 3. This embodiment is similar to that shown in FIG. 1 and for convenience components in FIG. 3 that are similar to components in FIG. 1 are assigned the same reference numerals, analogous but changed components are assigned the same reference numerals accompanied by the letter "A", and different components are assigned different numerals.

A multiple-sensor status monitoring system 100A has sensor inputs 101, 103, 105 and 107 connected to identical latch circuits 109A, 113A, 115A and 117A through conductors 111, 119, 121 and 123, respectively.

Figure 4:
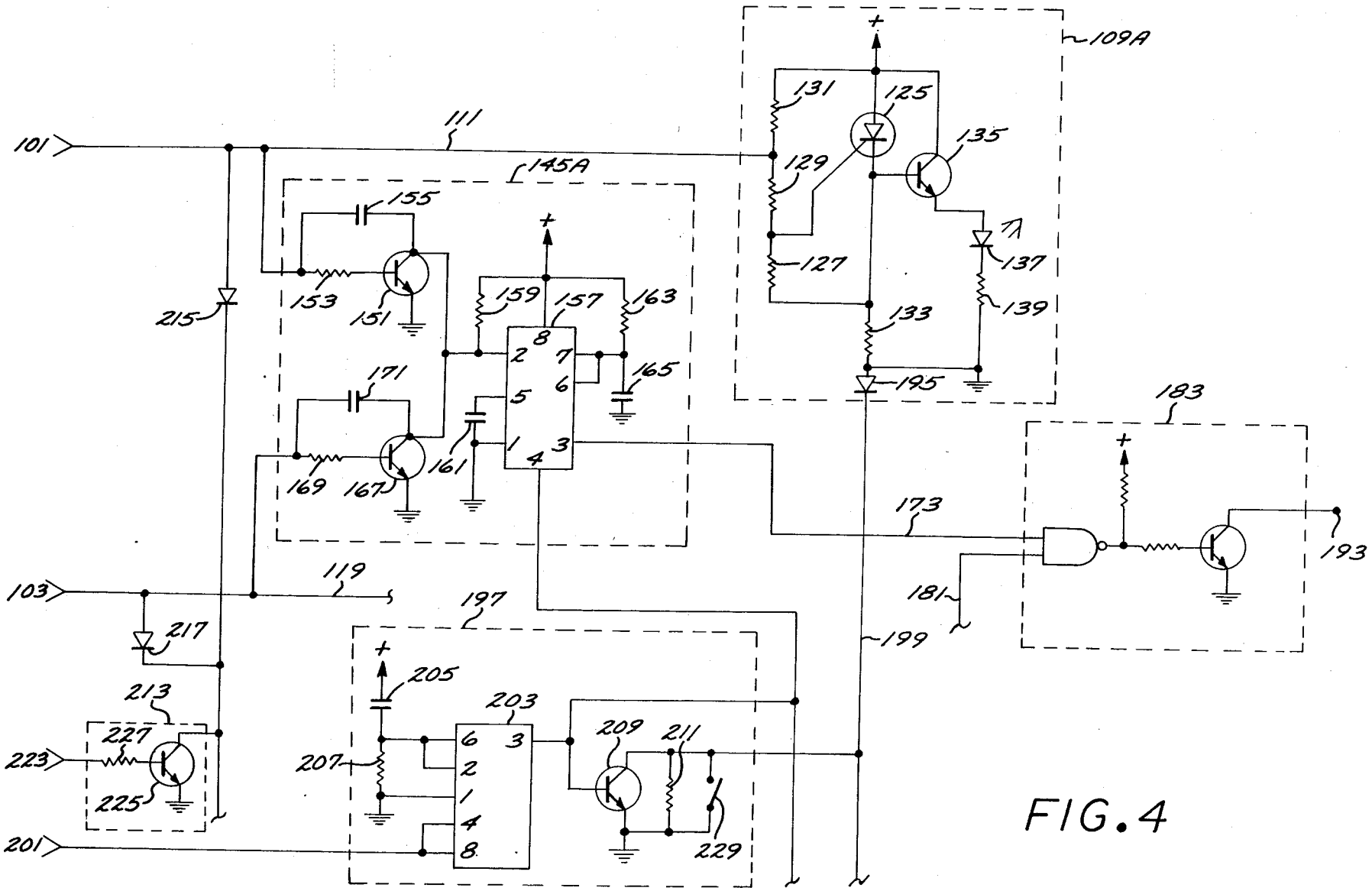
FIG. 4 is a schematic diagram of the circuitry contained within box 2A of FIG. 3.

Latch circuit 109A, shown schematically in FIG. 4, is similar to latch circuit 109 as shown in FIG. 2 except that cathode resistor 133 of SCR 125, instead of connecting directly to ground, connects through diode 195 to exit delay circuit 197 through conductor 199. Identical latch circuits 113A, 115A and 117A are also connected to exit delay circuit 197 in a like manner.

Exit delay circuit 197 has input 201, type 555 IC 203, time determinants 205 and 207, transistor 209, and resistor 211. Initially, input 201 is kept at ground level, causing output pin 3 of IC 203 to be at ground level. Transistor 209 is cut off, no current can flow through conductor 199, and latches 109A, 113A, 115A and 117A are prevented from latching whether or not primary sensor signals are presented to their inputs. If a positive voltage is applied to input 201, output pin 3 of IC 203 goes to a positive level after a period of time determined by components 205 and 207. Once output pin 3 goes to a positive level, transistor 209 switches on, providing a path from conductor 199 to ground and enabling latches 109A, 113A, 115A and 117A to latch in response to primary sensor signals.

Timer circuit 145A, shown schematically in FIG. 4, and identical timer circuit 179A are similar to timers 145 and 179 as shown in FIGS. 1 and 2, except that reset pin 4 of IC 157 is used to control operation of timer 145A and reset pin 4 of the corresponding IC in timer 179A is used to control operation of timer 179A. Reset pins 4 of both ICs are connected to output pin 3 of IC 203 in exit delay circuit 197, and, as long as said pin 3 remains at ground level, timers 145A and 179A cannot function. Only after said pin 3 goes to a high level can either timer generate a timer output signal in response to primary signals from the associated sensors.

Exit delay circuit 197, then, activates the system a predetermined time after a positive voltage is applied to input 201. This makes it possible for a person to turn the system on at a control panel located within the protected premises, and then to leave the building without setting off the alarm.

Sensor inputs 101, 103, 105 and 107 are also connected to freeze circuit 213 through diodes 215, 217, 219 and 221, respectively. So long as input 223 to freeze circuit 213 is kept at ground level, transistor 225 remains cut off and has no effect on the performance of the system. If a positive voltage is applied to input 223 and from there to the base of transistor 225 through resistor 227, transistor 225 turns on, effectively grounding the cathodes of diodes 215, 217, 219 and 221. Grounding said cathodes has the effect of shorting inputs 101, 103, 105 and 107 to ground and thereby rendering the system insensitive to primary sensor signals applied to any of said inputs. This circuit is useful to prevent activation of the alarm system when a person desires to walk through the protected area to turn off the system. By applying a positive voltage to input 223, the system is rendered insensitive to primary sensor signals; however, any latches that have previously been latched remain latched even though freeze circuit 213 has been activated, so that the operator can tell by observing the LEDs which of the sensors provided primary signals during the hours the system was in operation. This information tells which sensors have given spurious responses and makes quick, efficient repair possible.

After the operator has observed which LEDs are illuminated, the system is turned off by removing the positive enabling voltage from input 201. If it is desired to test the sensors for proper operation, switch 229 is closed by the operator, enabling the latch circuits, but not the timers, to function. Then a stimulus is deliberately introduced throughout the protected area, and the operator observes the LEDs to see which ones are lit. If a LED remains unlit, the operator knows that the associated sensor failed to respond to the stimulus, and repairs can be effected.

Figure 5:
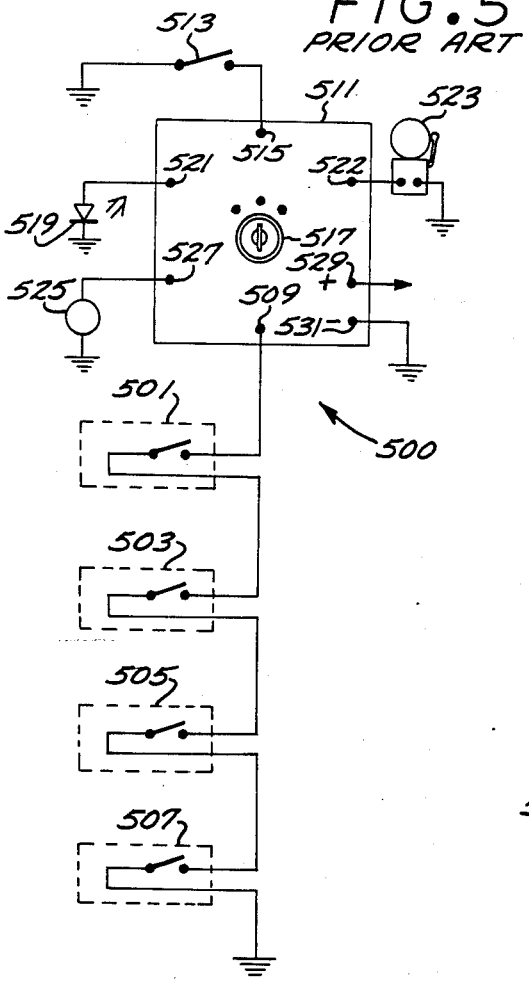
FIG. 5 PRIOR ART
FIG. 5 is a block diagram of a multiple-sensor status monitoring system according to the prior art.

A particularly useful embodiment of the present invention comprises a unit that can be retrofitted to an existing status monitoring system, such as a burglar alarm. Such an existing, prior art status monitoring system 500, illustrated in block form in FIG. 5, has sensors 501, 503, 505 and 507 connected to sensor input 509 of alarm panel 511 and sensor 513 connected to special sensor input 515. When an operator desires to activate the system, switch 517 is turned to position #3 and an active signal is thereby applied to LED 519 through connection 521 to indicate that the system is active. An internal timing element (not shown) delays actual system activation for a short period of time to permit the operator to leave the premises without setting off the alarm, and thereafter, if any of sensors 501, 503, 505 or 507 provides a primary signal by momentarily becoming an open circuit, an alarm output signal is provided at terminal 522 to activate a suitable alarm such as alarm bell 523.

A primary signal from sensor 513 has a different effect. If sensor 513 provides a primary signal by becoming an open circuit, an alert signal device 525, such as a buzzer or warning light, is activated by an alert signal at output 527, and unless the alarm system is turned off within a predetermined time thereafter, alarm 523 is sounded. However, once sensor 513 has provided a primary signal, the system is rendered unresponsive to primary signals from any of the other sensors. Sensor 513 is so located that the operator activates it upon entering the building, and so long as the operator proceeds directly to panel 511 and shuts off the system within said predetermined time, alarm 523 will not be sounded. The system is turned off by turning switch 517 to position #2 (standby) or #1 (power off).

Figure 6:
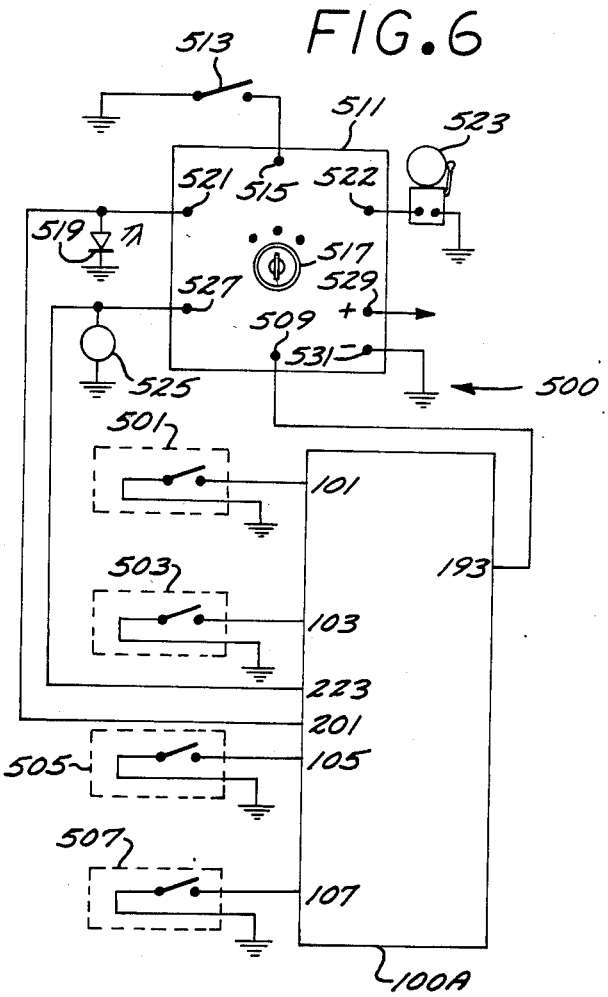
FIG. 6 is a block diagram of the multiple-sensor status monitoring system of FIG. 5, with circuitry embodying the present invention added thereto as an improvement.

Multiple-sensor status monitoring system 100A can be connected to existing burglar alarm system 500 to form a complete multiple-sensor burglar alarm system having all the advantages of the present invention, as shown in FIG. 6. Sensors 501, 503, 505 and 507 are disconnected from terminal 509 of burglar alarm 500 and are instead connected to inputs 101, 103, 105 and 107 of monitoring system 100A. Terminal 521 of burglar alarm 500 is connected to input 201 of monitoring system 100A, so that an active signal at terminal 521 starts the exit delay timer of monitoring system 100A. Terminal 527 of burglar alarm 500 is connected to input 223 of monitoring system 300, so that an alert signal from burglar alarm 500 activates the freeze circuit of monitoring system 100A. Output 193 of monitoring system 100A is connected to sensor input 509 of burglar alarm 500. Finally, operating power for monitoring system 100A can be drawn from power terminals 529 and 531 of burglar alarm 500.

When the complete multiple-sensor burglar alarm system is in operation, an operator can activate the system, as before, by setting switch 517 to position #3. The operator then has a short interval of time within which to leave the protected area without setting off the alarm. Thereafter, if both timer 145A and timer 179A of monitoring system 100A produce overlapping timer output signals, a status change signal is applied to input 509 and the alarm sounds. The latches and LEDs of monitoring system 100A tell which sensors have provided primary response signals. When the operator returns and wishes to shut off the complete system, sensor 513 is activated, causing an alert signal to be applied to input 223 and thereby rendering system 100A insensitive to any further sensor activations.

It will be apparent from the preceding description that this invention provides a multiple-sensor alarm system having not only the ability to avoid false alarms but also the ability to warn of sensor failures and to identify the failed sensor or sensors for repair or replacement. Such a multiple-sensor system is provided either as a stand-alone system or as a retrofit to be added to an existing alarm system not having these desirable features.

Although one specific embodiment of this invention has been described and illustrated, it is to be understood that the invention is not to be limited to the specific forms or arrangements of parts so described and illustrated, and that various changes can be made within the scope of the invention. It is therefore to be understood that, within the scope of the appended claims, the invention may be practiced otherwise than as specifically described.

I claim:

1. A status monitoring system comprising:

a plurality of status sensors, each operative to provide a primary signal in response to a stimulus;

storage means associated with each of said sensors, each of said storage means being responsive to a primary signal from the associated one of said sensors to store a record of the occurrence of a primary signal from said associated sensor;

indicator means connected to said storage means, operative to provide an indication of the storage of a record of the occurrence of a primary signal;

a plurality of timers, each of said timers being connected to at least one of said sensors, each of said timers being responsive to a primary signal from any one of the sensors connected thereto to provide a timing output signal having a predetermined duration; and logic means responsive to said timers to generate a status change signal when a plurality of said timing output signals are being provided simultaneously.

2. A status monitoring system according to claim 1, wherein each of said sensors is connected to one and only one of said timers.

3. A status monitoring system according to claim 1, further comprising means to render said storage means and said timers unresponsive to primary signals from their respective associated sensors.

4. A status monitoring system according to claim 3, further comprising a delay timing means operative to render said storage means and timers responsive to primary signals from their respective associated sensors after a predetermined interval of time has elapsed.

5. A status monitoring system according to claim 3, further comprising means to render said storage means responsive to primary signals from their respective associated sensors.

6. A status monitoring system comprising:

a plurality of status sensors, each operative to provide a primary signal in response to a stimulus;

storage means associated with each of said sensors, each of said storage means being responsive to a primary signal from the associated one of said sensors to store a record of the occurrence of a primary signal from said associated sensor;

indicator means connected to said storage means, operative to provide an indication of the storage of a record of the occurrence of a primary signal;

a plurality of first timing means, one of said timing means being connected to each of said sensors, each of said first timing means being operative to generate a secondary signal of predetermined duration in response to the occurrence of a primary signal from the associated one of said sensors, the duration of each said secondary signal being independent of the duration of the associated primary signal;

a plurality of second timing means, each of said second timing means being connected to at least one of said first timing means, each of said second timing means being responsive to a secondary signal from any one of the first timing means connected thereto to provide a timing output signal having a predetermined duration; and logic means responsive to said second timing means to generate a status change signal when a plurality of said timing output signals are being provided simultaneously.

7. A status monitoring system according to claim 6, further comprising means to render said storage means unresponsive to primary signals from their respective associated sensors and means to render said second timing means unresponsive to secondary signals from their respective associated first timing means.

8. A status monitoring system according to claim 7, further comprising a delay timing means operative to render said storage means responsive to primary signals from their respective assosiated sensors, and to render said second timing means responsive to secondary signals from their respective associated first timing means, after a predetermined interval of time has elapsed.

9. A status monitoring system according to claim 7, further comprising means to render said storage means responsive to primary signals from their respective associated sensors.

10. A malfunction-detecting system for reducing false alarms from a status monitoring system having a plurality of status sensors, each of said sensors being operative to generate a primary signal in response to a change in the status being monitored, comprising:

a plurality of storage means, each of said sensors having one of said storage means connected thereto, each of said storage means being responsive to a primary signal from the associated one of said sensors to store a record of the occurrence of a primary signal from said associated sensor;

indicator means, connected to said storage means, operative to provide an indication of the storage of a record of the occurrence of a primary signal by said storage means;

a plurality of timers, each of said timers being connected to at least one of said sensors, each of said timers being responsive to a primary signal from any one of the sensors connected thereto to provide a timing output signal having a predetermined duration; and logic means responsive to said timers to generate a status change signal when a plurality of said timing output signals are being provided simultaneously.

11. A status monitoring system according to claim 10, further comprising means to render said storage means and said timers unresponsive to primary signals from their respective associated sensors.

12. A status monitoring system according to claim 11, further comprising a delay timing means operative to render said storage means and timers responsive to primary signals from their respective associated sensors after a predetermined interval of time has elapsed.

13. A status monitoring system according to claim 11, further comprising means to render said storage means responsive to primary signals from their respective associated sensors.

14. A status monitoring system according to claim 10, wherein said storage means comprises a silicon-controlled rectifier wired in a latch circuit, and said indicator means comprises a visual indicator.

15. A status monitoring system according to claim 10, wherein said second timing means each comprises a monostable multivibrator.

16. A malfunction-detecting system for reducing false alarms from a status monitoring system having a plurality of status sensors, each of said sensors being operative to generate a primary signal in response to a change in the status being monitored, comprising:

a plurality of storage means, each of said sensors having one of said storage means connected thereto, each of said storage means being responsive to a primary signal from the associated one of said sensors to store a record of the occurrence of a primary signal from said associated sensor;

indicator means connected to said storage means, operative to provide an indication of the storage of a record of the occurrence of a primary signal;

a plurality of first timing means, one of said timing means being connected to each of said sensors, each of said first timing means being operative to generate a secondary signal of predetermined duration in response to the occurrence of a primary signal from the associated one of said sensors, the duration of each said secondary signal being independent of the duration of the associated primary signal;

a plurality of second timing means, each of said second timing means being connected to at least one of said first timing means, each of said second timing means being responsive to a secondary signal from any one of the first timing means connected thereto to provide a timing output signal having a predetermined duration; and logic means responsive to said second timing means to generate a status change signal when a plurality of said timing output signals are being provided simultaneously.

17. A status monitoring system according to claim 16, further comprising means to render said storage means unresponsive to primary signals from their respective associated sensors and means to render said second timing means unresponsive to secondary signals from their respective associated first timing means.

18. A status monitoring system according to claim 17, further comprising a delay timing means operative to render said storage means responsive to primary signals from their respective associated sensors, and to render said second timing means responsive to secondary signals from their respective associated first timing means, after a predetermined interval of time has elapsed.

19. A status monitoring system according to claim 17, further comprising means to render said storage means responsive to primary signals from their respective associated sensors.

20. A status monitoring system according to claim 16, wherein said storage means comprises a silicon-controlled rectifier wired in a latch circuit, and said indicator means comprises a visual indicator.

21. A status monitoring system according to claim 16, wherein said second timing means each comprises a monostable multivibrator.

22. An improvement to a multiple-sensor alarm system having a plurality of sensors, each of said sensors being operative to generate a primary signal in response to a stimulus, said alarm system being operative to generate a first alarm signal immediately upon the activation of a predetermined one of said sensors and a second alarm signal a predetermined time after the activation of said predetermined sensor, said alarm system also being operative to generate said second alarm signal in response to the activation of any of the others of said sensors, said alarm system also being operative to generate an armed signal when said system has been activated, said improvement comprising:

delay timing means, responsive to said armed signal, operative to generate an active signal after said armed signal has been present a predetermined interval of time;

a plurality of storage means, one of said storage means being connected to each of said sensors except said predetermined one, each of said storage means responsive to a primary signal from the associated one of said sensors to store a record of the occurrence of a primary signal from said associated sensor;

indicator means connected to said storage means, operative to provide an indication of the storage of a record of the occurrence of a primary signal;

a plurality of first timing means, one of said first timing means being connected to each of said sensors except said predetermined one, each of said timing means being operative to generate a secondary signal of predetermined duration in response to the occurrence of a primary signal from the associated one of said sensors, the duration of each said secondary signal being independent of the duration of the associated primary signal;

a plurality of second timing means, each of said second timing means being connected to at least one of said first timing means, each of said second timing means being responsive to a secondary signal from any one of the first timing means connected thereto to provide a timing output signal having a predetermined duration;

logic means responsive to said second timing means to generate a status change signal having characteristics similar to the characteristics of a primary signal as generated by said sensors when a plurality of said timing output signals are being provided simultaneously;

means to prevent the generation of said status change signal unless said active signal is present and said first alarm signal is not present; and means to render said storage means unresponsive to primary signals from their respective associated sensors unless said active signal is present and said first alarm signal is not present.

23. The improvement according to claim 22, further comprising means to render said storage means responsive to primary signals from their respective associated sensors in the absence of said active signal.

* * * * *